US010456895B2

(12) United States Patent
Ely

(10) Patent No.: US 10,456,895 B2
(45) Date of Patent: Oct. 29, 2019

(54) RATCHET TOOLS

(71) Applicant: Ingersoll-Rand Company, Davidson, NC (US)

(72) Inventor: Sean C. Ely, Flemington, NJ (US)

(73) Assignee: Ingersoll-Rand Company, Davidson, NC (US)

( * ) Notice: Subject to any disclaimer, the term of this patent is extended or adjusted under 35 U.S.C. 154(b) by 79 days.

(21) Appl. No.: 15/156,728

(22) Filed: May 17, 2016

(65) Prior Publication Data

US 2016/0256987 A1 Sep. 8, 2016

Related U.S. Application Data

(62) Division of application No. 14/013,499, filed on Aug. 29, 2013, now abandoned.

(51) Int. Cl.
*B25B 21/00* (2006.01)

(52) U.S. Cl.
CPC ..... *B25B 21/004* (2013.01)

(58) Field of Classification Search
CPC . B25B 21/004; B25B 21/008; B25B 23/0007; B25B 23/141; B25B 23/14; B25B 13/46; H02K 7/108; H02K 7/145
USPC ..... 81/57.39
See application file for complete search history.

(56) References Cited

U.S. PATENT DOCUMENTS 581,427 A * 4/1897 Olson ..... B25B 13/467 192/43.1
2,979,089 A 4/1961 Piesker
3,802,518 A 4/1974 Albert
4,078,589 A 3/1978 Miller
4,215,601 A * 8/1980 Mann ..... B25B 27/00 81/57.13
4,406,183 A * 9/1983 Wix ..... B25B 13/467 192/95
4,448,098 A * 5/1984 Totsu ..... B25B 15/04 81/467
4,474,089 A * 10/1984 Scott ..... B25B 17/00 81/57.29
4,589,307 A * 5/1986 Parker ..... B25B 13/463 81/62
4,617,843 A 10/1986 Nishida et al.
4,754,669 A 7/1988 Verdier et al.
4,974,475 A 12/1990 Lord et al.
(Continued)

*Primary Examiner* — Hadi Shakeri

(74) *Attorney, Agent, or Firm* — Jones IP Group; Wayne A. Jones

(57) ABSTRACT

Illustrative embodiments of ratchet tools are disclosed. In one embodiment, a ratchet tool may comprise a handle extending along a handle axis and housing a motor, a head coupled to the handle at a first end of the handle, the head supporting an output shaft configured to be driven by the motor to rotate about an output axis, the output axis being substantially perpendicular to the handle axis, a ratchet mechanism coupled between the handle and the output shaft, the ratchet mechanism configured to restrict rotation of the output shaft in a first direction and to allow rotation of the output shaft in a second direction opposite the first direction, and a direction control configured to switch the first direction associated with the ratchet mechanism between a clockwise and a counterclockwise direction, the direction control being coupled to the handle and spaced apart from the head along the handle axis.

6 Claims, 3 Drawing Sheets

(56) References Cited

U.S. PATENT DOCUMENTS

| | | | | | |
|---|---|---|---|---|---|
| 5,058,463 | A | | 10/1991 | Wannop | |
| 5,251,706 | A | | 10/1993 | Evans | |
| 5,412,546 | A | | 5/1995 | Huang | |
| 5,448,931 | A | * | 9/1995 | Fossella | B25B 13/44 81/128 |
| 5,740,892 | A | | 4/1998 | Huang | |
| 5,839,518 | A | | 11/1998 | Setsuko | |
| 6,093,128 | A | * | 7/2000 | Seith | B25B 21/00 173/216 |
| 6,112,621 | A | * | 9/2000 | Ochiai | B25B 17/00 81/57.13 |
| 6,186,247 | B1 | | 2/2001 | Wang | |
| 6,199,642 | B1 | * | 3/2001 | Becker | B25B 21/00 173/216 |
| 6,209,658 | B1 | | 4/2001 | Yoon | |
| 6,457,386 | B1 | | 10/2002 | Chiang | |
| 7,069,818 | B1 | * | 7/2006 | Huang | B25B 13/465 81/57.29 |
| 7,836,797 | B2 | | 11/2010 | Hecht et al. | |
| 8,051,746 | B2 | * | 11/2011 | Bouchard | B25B 21/004 81/57.39 |
| 8,695,725 | B2 | * | 4/2014 | Lau | B25F 3/00 173/170 |
| 2004/0060718 | A1 | * | 4/2004 | Izumisawa | B25F 5/00 173/169 |

* cited by examiner

RATCHET TOOLS

CROSS REFERENCE TO RELATED APPLICATION

This application is a divisional application of U.S. patent application Ser. No. 14/013,499, filed Aug. 29, 2013, the entire disclosure of which is incorporated by reference herein.

TECHNICAL FIELD

The present disclosure relates, generally, to ratchet tools and, more particularly, to ratchet tools operable in both a powered mode and in a manual mode.

BACKGROUND

Ratchet tools are used to rotate fasteners, such as bolts and nuts, in either a clockwise or a counterclockwise direction to tighten or loosen the fasteners. Many ratchet tools include a output shaft configured to engage a fastener (e.g., via a socket removably coupled to the output shaft), a handle configured to be pivoted back-and-forth relative to the output shaft, and a ratchet mechanism coupled between the output shaft and the handle. The ratchet mechanism is generally configured to restrict rotation of the output shaft in one direction while allowing rotation of the output shaft in the opposite direction. Thus, a user pivoting the handle of a ratchet tool back-and-forth can manually drive a fastener in a single direction. Powered ratchet tools further include a motor configured to drive rotation of the output shaft when operating in a powered mode.

SUMMARY

According to one aspect, a ratchet tool may include an output shaft, a motor, and a transmission coupled between the output shaft and the motor. The transmission may include a ratchet mechanism and a speed-sensitive clutch. The speed-sensitive clutch may be configured to connect the output shaft to the motor when the motor provides rotation to the transmission above a predetermined speed so that the output shaft is driven by the motor. The speed-sensitive clutch may also be configured to disconnect the output shaft from the motor when the motor does not provide rotation to the transmission above the predetermined speed so that the output shaft is free to be rotated manually without resistance from the motor.

In some embodiments, the speed-sensitive clutch may be a centrifugal clutch. The speed-sensitive clutch may be coupled between the ratchet mechanism and the motor.

In some embodiments, the motor may include a rotor coupled to the transmission. The rotor may be configured to rotate about a motor axis. The output shaft may be configured to rotate about an output axis that is non-parallel to the motor axis.

In some embodiments, the ratchet tool may include a direction control coupled to the rachet mechanism. The direction control may be configured to select a direction of ratchet mechanism engagement. The direction control may be spaced apart from the output axis.

In some embodiments, the ratchet tool may include a power control coupled to the motor. The power control may be configured to control rotation of the rotor. The power control may be positioned near the direction control to allow one-handed operation of both the power control and the direction control.

In some embodiments, the ratchet mechanism may be spaced apart from the output axis. The ratchet tool may include a direction control coupled to the rachet mechanism and configured to select a direction of ratchet mechanism engagement. The direction control may be spaced apart from the output axis.

In some embodiments, the transmission may include a first bevel gear configured to rotate about a first axis parallel to the motor axis and a second bevel gear configured to rotate about a second axis parallel to the output axis. The second bevel gear may mesh with the first bevel gear.

According to another aspect, a ratchet tool may include a handle extending along a handle axis and housing a motor and a head coupled to the handle at a first end of the handle. The head may support an ouput shaft configured to be driven by the motor to rotate about an output axis. The output axis may be substantially perpendicular to the handle axis. The ratchet tool may further include a ratchet mechanism coupled between the handle and the output shaft. The ratchet mechanism may be configured to restrict rotation of the output shaft in a first direction and to allow rotation of the output shaft in a second direction opposite the first direction. The ratchet tool may further include a direction control configured to switch the first direction associated with the ratchet mechanism between a clockwise and a counterclockwise direction. The direction control may be coupled to the handle and may be spaced apart from the head along the handle axis.

In some embodiments, the direction control may be spaced at least one-third of a length of the handle away from the first end of the handle. The direction control may be spaced at least two-thirds of the length of the handle away from the first end of the handle. The ratchet mechanism may be spaced apart from the head along the handle axis. The ratchet mechanism may include a pawl and a toothed wheel, the toothed wheel being configured to rotate about a ratchet axis that is parallel to the handle axis.

In some embodiments, the ratchet tool may include a mechanical linkage coupled between the direction control and the ratchet mechanism. The mechanical linkage may extend generally parallel to the handle axis.

In some embodiments, the ratchet tool may further include a speed-sensitive clutch coupled between the motor and the output shaft. The speed-sensitive clutch may be configured to disconnect the output shaft from the motor when the motor does not provide rotation above a predetermined speed. The speed-sensitive clutch may be housed in the handle and may be positioned between the motor and the ratchet mechanism along the handle axis.

In some embodiments, the ratchet tool may further include a power control coupled to the motor. The power control may be movable between an on position in which the motor drives rotation of the output shaft and an off position in which the motor does not drive rotation of the output shaft. The direction control may be coupled to the power control and may be configured to select a direction of rotation provided by the motor when the power control is in the on position.

In some embodiments, the head may include an input bevel gear and an output bevel gear. The input bevel gear may be configured to rotate about the handle axis. The ouput bevel gear may be configured to rotate about the output axis.

BRIEF DESCRIPTION OF THE DRAWINGS

The concepts described in the present disclosure are illustrated by way of example and not by way of limitation in the accompanying figures. For simplicity and clarity of illustration, elements illustrated in the figures are not necessarily drawn to scale. For example, the dimensions of some elements may be exaggerated relative to other elements for clarity. Further, where considered appropriate, reference labels have been repeated among the figures to indicate corresponding or analogous elements.

DETAILED DESCRIPTION OF THE DRAWINGS

Figure 1:
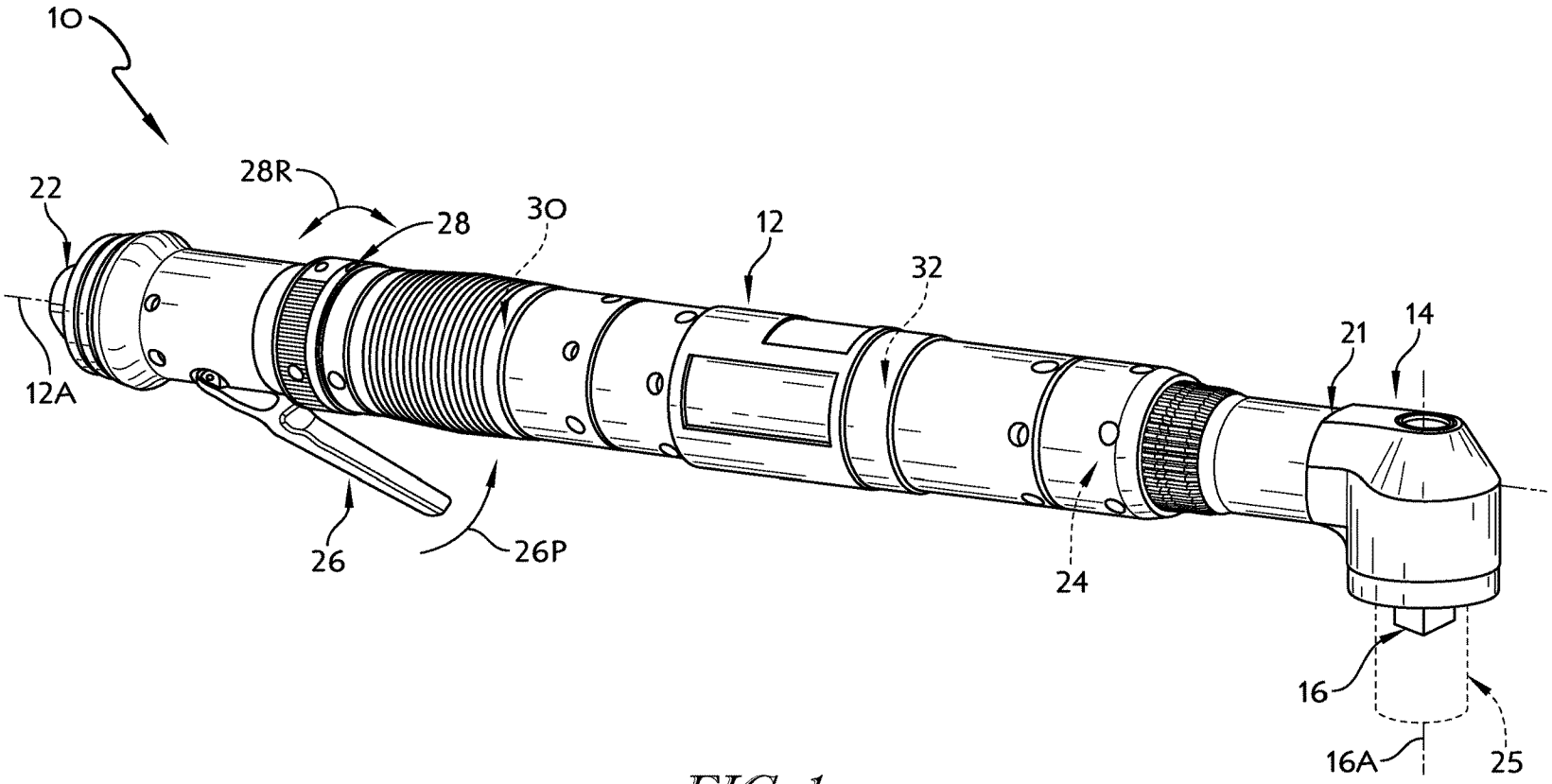
FIG. 1 is a perspective view of one illustrative embodiment of a ratchet tool operable in both a powered mode and in a manual mode.

While the concepts of the present disclosure are susceptible to various modifications and alternative forms, specific exemplary embodiments thereof have been shown by way of example in the drawings and will herein be described in detail. It should be understood, however, that there is no intent to limit the concepts of the present disclosure to the particular forms disclosed, but on the contrary, the intention is to cover all modifications, equivalents, and alternatives falling within the spirit and scope of the present disclosure.

Referring now to FIG. 1, one illustrative embodiment of a ratchet tool 10 that is operable in both a powered mode and in a manual mode is shown. In the powered mode, a motor 30 included in the ratchet tool 10 drives rotation of an output shaft 16 to tighten or loosen a fastener. In the manual mode, a user may pivot the ratchet tool 10 to manually drive rotation of the output shaft 16, thereby tightening or loosening a fastener. As described in further detail below, the ratchet tool 10 is configured such that the motor 30 does not provide resistance to the rotation of the output shaft 16 when the ratchet tool 10 is operated in the manual mode.

The ratchet tool 10 illustratively includes a handle 12 and a head 14 coupled to the handle 12. The handle 12 is sized to be gripped by a user's hand and extends along a handle axis 12A. The head 14 is coupled to a first end 21 of the handle 12 and supports the output shaft 16, which is configured to rotate about an output axis 16A, as shown in FIG. 1. The output shaft 16 is configured to be removably coupled to one of a plurality of interchangeable sockets 25 to transfer rotation of the output shaft 16 to a fastener (not shown).

The ratchet tool 10 also includes a power control 26 and a direction control 28. In the illustrative embodiment of FIG. 1, the power control 26 and the direction control 28 are each coupled to the handle 12 near a second end 22 of the handle 12. The power control 26 is illustratively embodied as a pivot switch that pivots relative to handle 12, as suggested by arrow 26P, to change the operation of the ratchet tool 10 between the manual and powered modes of operation. The direction control 28 is illustratively embodied as a rotatable ring that rotates about the handle axis 12A, as suggested by arrow 28R, to change the direction of rotation of the output shaft 16, during powered and manual operation of the ratchet tool 10, to facilitate tightening or loosening of a fastener.

In the powered mode of operation, a user squeezes the power control 26 to cause the motor 30 housed in the handle 12 to drive rotation of the output shaft 16. Rotation of the output shaft 16 subsequently tightens or loosens a fastener engaged by the socket 25 coupled to the output shaft 16. In the manual mode of operation, a user releases the power control 26 and manually pivots the handle 12 to tighten or loosen a fastener. A ratchet mechanism 24 housed in the handle 12 allows a user to pivot the handle 12 back-and-forth relative to the output shaft 16 to cause rotation of the output shaft 16 in a single direction. In the manual mode of operation, a user may be able to apply a torque through the ratchet tool 10 greater than what is provided during the powered mode of operation. Thus, the manual mode of operation might be used during final tightening or initial breaking loose of a fastener.

Figure 2:
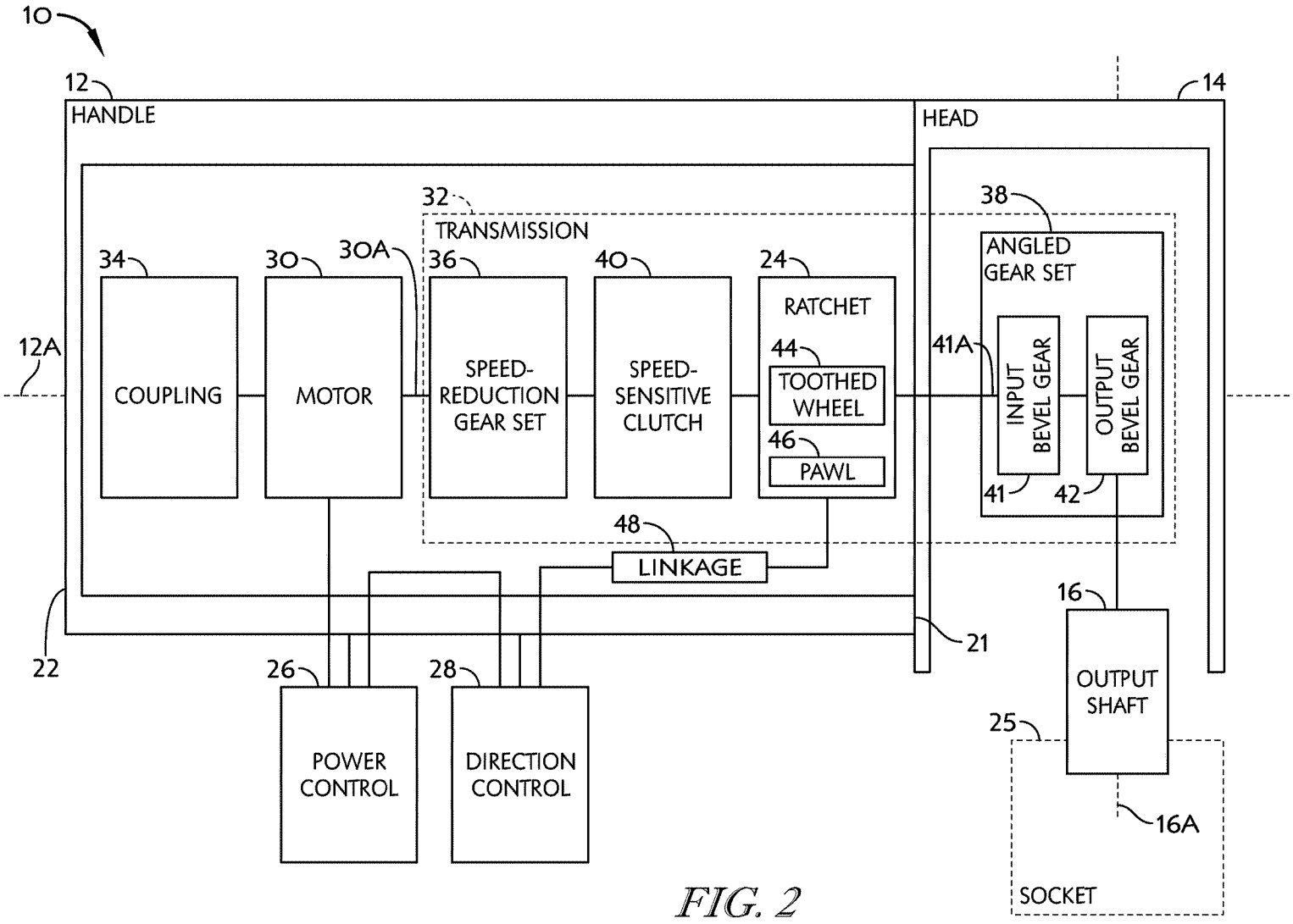
FIG. 2 is a block diagram of the ratchet tool shown in FIG. 1.

Turning now to FIG. 2, the ratchet tool 10 is shown to include a transmission 32 that extends through the handle 12 and into the head 14. The motor 30 includes a rotor configured to rotate about a motor axis 30A to provide rotation to the transmission 32. In the illustrative embodiment, the motor axis 30A is parallel to (and collinear with) the handle axis 12A. The transmission 32 is configured to connect the motor 30 to the output shaft 16 when the ratchet tool 10 is in the powered mode of operation and to disconnect the motor 30 from the output shaft 16 when the ratchet tool 10 is in the manual mode of operation.

The motor 30 is illustratively embodied as a pneumatic motor configured to be powered by pressurized air, as suggested in FIGS. 1 and 2. The illustrative ratchet tool 10 includes a coupling 34 configured to removably couple the motor 30 to a source of pressurized air source, such as an air hose connected to a compressor or an air tank. In other embodiments, the motor 30 may be an electric motor and the coupling 34 may be configured to couple the motor 30 to source of electrical power (e.g., an electrical outlet or a battery).

The transmission 32 includes a speed-reduction gear set 36, an angled gear set 38, a speed-sensitive clutch 40, and the ratchet mechanism 24, as shown diagrammatically in FIG. 2. The speed-reduction gear set 36 lowers the speed of rotation provided by the motor 30 to raise the torque provided to the output shaft 16 during the powered mode of operation. The angled gear set 38 redirects rotation from the motor 30 so that the output shaft 16 is driven to rotate about the output axis 16A. In the illustrative embodiment, the output axis 16A is substantially perpendicular to the motor axis 30A. The speed-sensitive clutch 40 is configured to connect the output shaft 16 to the motor 30 when the motor 30 provides rotation to the transmission 32 above a predetermined speed. The ratchet mechanism 24 is configured to allow rotation of the output shaft 16 in a single direction about the output axis 16A.

In the illustrative embodiment of FIG. 2, the speed-reduction gear set 36 is coupled between the motor 30 and the speed-sensitive clutch 40. When the speed-sensitive clutch 40 disconnects the motor 30 from the output shaft 16, the speed-reduction gear set 36 is also disconnected from the output shaft 16 so that rotation of the output shaft 16 is not subject to resistance from the speed-reduction gear set 36. The speed-reduction gear set 36 may be illustratively embodied as a planetary gear set configured to reduce the speed of rotation provided by the motor 30. In other embodiments, the speed-reduction gear set 36 may be another speed-reduction unit (e.g., a pulley set or the like).

In the illustrative embodiment, the angled gear set 38 is housed in the head 14 and is coupled between the output shaft 16 and the ratchet mechanism 24, as shown in FIG. 2. The angled gear set 38 redirects rotation of the rotor of the motor 30 about the motor axis 30A to rotation of the output shaft 16 about the output axis 16A, which is substantially perpendicular to the motor axis 30A. The angled gear set 38 illustratively includes an input bevel gear 41 coupled to the ratchet mechanism 24 and an output bevel gear 42 coupled to the output shaft 16. The input bevel gear 41 is configured to rotate about an input bevel axis 41A that is parallel to (and, illustratively, co-linear with) the handle axis 12A and the motor axis 30A. The output bevel gear 42 is configured to rotate about an output bevel axis 42A that is parallel to (and, illustratively, co-linear with) the output axis 16A.

In the illustrative embodiment of FIG. 2, the speed-sensitive clutch 40 is coupled between the motor 30 and the ratchet mechanism 24. The speed-sensitive clutch 40 is configured to connect the output shaft 16 to the motor 30 when the motor 30 provides rotation to the transmission 32 above a predetermined speed so that the output shaft 16 is driven by the motor 30 and to disconnect the output shaft 16 from the motor 30 when the motor 30 does not provide rotation to the transmission 32 above the predetermined speed so that the output shaft 16 is free to be rotated manually without resistance from the motor 30. In the illustrative embodiment, the speed-sensitive clutch 40 is a centrifugal clutch, in which rotation of a clutch input (driven by the motor 30) imparts centrifugal forces on a mass. At or above a particular rotational speed, these centrifugal forces overcome an inward biasing force to drive the mass outward and into engagement with a clutch output, thereby transferring rotation through the centrifugal clutch. In other embodiments, the speed-sensitive clutch 40 may be another type of speed-sensitive unit such as an electronic clutch including a speed sensor, an actuator, and a controller.

The ratchet mechanism 24 is illustratively coupled between the speed-sensitive clutch 40 and the angled gear set 38, as shown in FIG. 2. The ratchet mechanism 24 is housed in the handle 12 and is spaced apart from the head 14 (and, hence, from the output axis 16A), allowing the head 14 to maintain a low profile for use in tight spaces. The ratchet mechanism 24 is configured restrict rotation of the output shaft 16 in one direction and to allow rotation of the output shaft 16 in the opposite direction. For example, the ratchet mechanism 24 may restrict rotation of the output shaft 16 in the clockwise direction while allowing rotation of the output shaft 16 in the counter-clockwise direction (or vice versa). Thus, the ratchet mechanism 24 allows a user to pivot the handle 12 back-and-forth relative to the output shaft 16 to cause rotation of the output shaft 16 in a single direction.

In the illustrative embodiment, the ratchet mechanism 24 includes a toothed wheel 44 and a pawl 46, as diagrammatically shown in FIG. 2. The toothed wheel 44 is mounted for rotation about a wheel axis 44A that is parallel to (and, illustratively, collinear with) the motor axis 30A and the handle axis 12A. The pawl 46 is movable between one position in which the pawl 46 blocks rotation of the toothed wheel 44 (and thus the output shaft 16) in the clockwise direction and another position in which the pawl 46 blocks rotation of the toothed wheel 44 (and thus the output shaft 16) in the counterclockwise direction.

The power control 26 is coupled to the motor 30 and configured to control operation of the motor 30 (i.e., rotation of the rotor), as suggested in FIG. 2. In other words, when the power control 26 is in an "on" position, the motor 30 drives rotation of the output shaft 16 and, when the power control 26 is an "off" position, the motor 30 does not drive rotation of the output shaft 16. The power control 26 located near the second end 22 of handle 12 and is positioned near the direction control 28 to allow one-handed operation of both the power control 26 and the direction control 28 by a user.

In the illustrative embodiment, the direction control 28 is coupled to the power control 26 and is configured to select the direction of rotation provided by the motor 30. For instance, in some embodiments, the direction control 28 may change the configuration of the power control 26 (e.g., reversing pneumatic couplings or electrical connections within the power control 26) to select the direction of rotation provided by the motor 30. The direction control 28 is also coupled to the pawl 46 of the rachet mechanism 24 via a mechanical linkage 48 as shown, for example, in FIG. 2. Via the linkage 48, the direction control 28 is configured to move the pawl 46 between its positions to select a direction of engagement of the ratchet mechanism 24 (i.e., the direction in which the ratchet mechanism 24 restricts rotation).

The direction control 28 is illustratively located near the second end 22 of handle 12, as shown in FIGS. 1 and 2. In particular, the direction control 28 is spaced apart from the head 14 so that the direction of ratchet mechanism 24 engagement can be changed without reaching out to the head 14 during use of the ratchet tool 10 in tight spaces.

Figure 3:
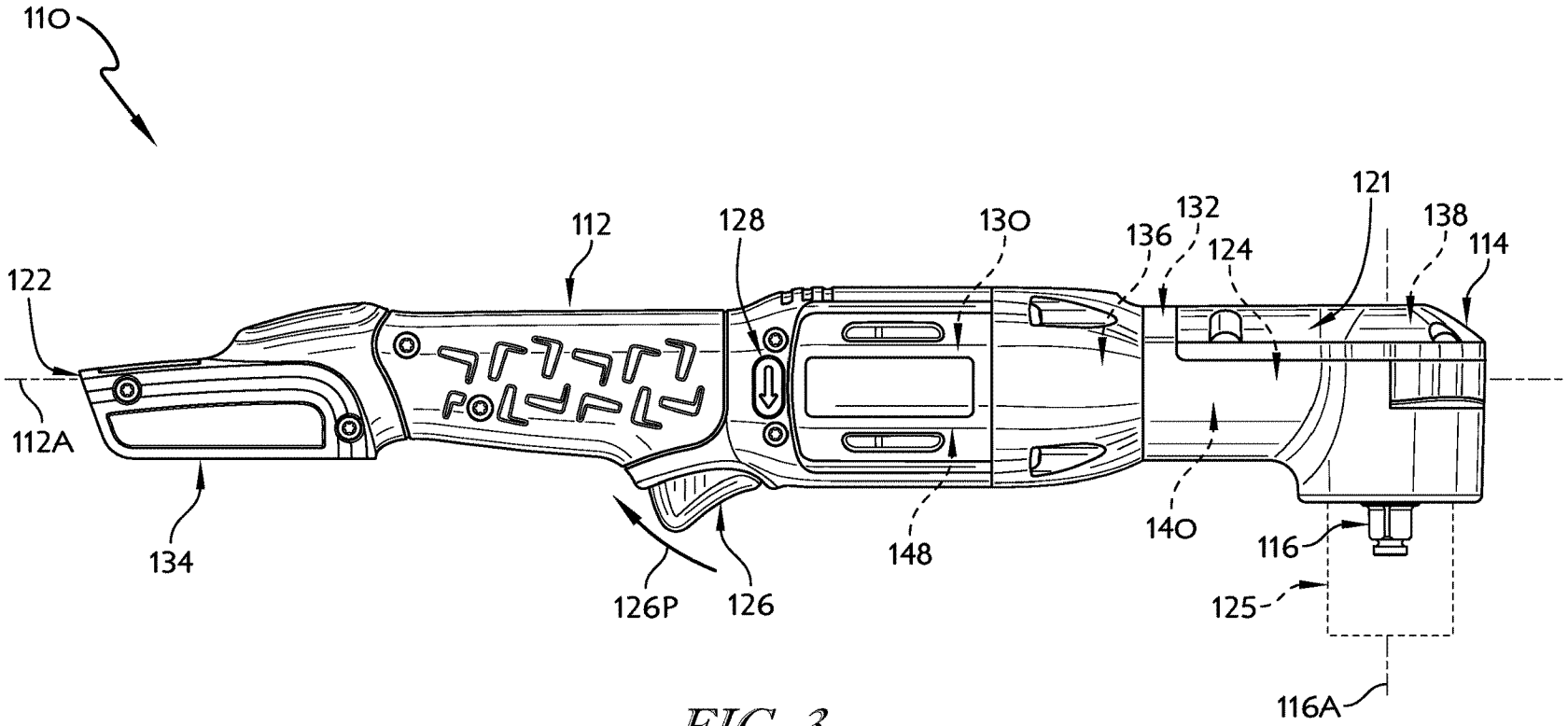
FIG. 3 is a side elevation view of another illustrative embodiment of a ratchet tool operable in both a powered mode and in a manual mode.

Another illustrative ratchet tool 110 is shown in FIG. 3. The ratchet tool 110 is substantially similar to the ratchet tool 10 shown in FIGS. 1-2 and described above. Accordingly, similar reference numbers (in the 100 series in FIG. 3) indicate features that are similar between the ratchet tool 10 and the ratchet tool 110. Furthermore, the description of the ratchet tool 10 (set forth above) also applies to the ratchet tool 110, except in instances when it conflicts with the specific description below of ratchet tool 110.

Unlike the ratchet tool 10, the power control 126 of the ratchet tool 110 is illustratively embodied as a trigger, as shown in FIG. 3. The power control 126 pivots relative to handle 112, as suggested by arrow 126P, to change the operation of the ratchet tool 110 between the manual and powered modes of operation. The direction control 128 is illustratively embodied as a button that slides perpendicular to the handle axis 112A to change the direction of rotation of the output shaft 116, during powered and manual operation of the ratchet tool 110. In addition, the coupling 134 of the ratchet tool 110 is configured to removably couple the motor 130 to a source of electrical power. More specifically, in the illustrative embodiment of FIG. 3, the coupling 134 is configured to receive a battery.

While certain illustrative embodiments have been described in detail in the figures and the foregoing description, such an illustration and description is to be considered as exemplary and not restrictive in character, it being understood that only illustrative embodiments have been shown and described and that all changes and modifications that come within the spirit of the disclosure are desired to be protected. There are a plurality of advantages of the present disclosure arising from the various features of the apparatus, systems, and methods described herein. It will be noted that alternative embodiments of the apparatus, systems, and methods of the present disclosure may not include all of the features described yet still benefit from at least some of the advantages of such features. Those of ordinary skill in the art may readily devise their own implementations of the apparatus, systems, and methods that incorporate one or more of the features of the present disclosure.

The invention claimed is:

1. A ratchet tool comprising:

a handle extending along a handle axis and housing a motor;

a head coupled to the handle at a first end of the handle, the head supporting an output shaft driven by the motor to rotate about an output axis, the output axis being substantially perpendicular to the handle axis;

wherein the head includes an input bevel gear that rotates about the handle axis and an output bevel gear that rotates about the output axis;

a gear reduction set located in the handle, adjacent and coupled to the motor;

a speed-sensitive clutch located in the handle and coupled to the gear reduction set;

a ratchet mechanism located in the handle between the speed-sensitive clutch and the input bevel gear in the head, wherein the ratchet mechanism includes a pawl and a toothed wheel both located in the handle, the toothed wheel being configured to rotate about a ratchet axis that is parallel to the handle axis, the ratchet mechanism configured to restrict rotation of the output shaft in a first direction and to allow rotation of the output shaft in a second direction opposite the first direction;

wherein the speed-sensitive clutch is coupled between the gear reduction set and the toothed wheel of the ratchet mechanism;

wherein at motor speeds below a predetermined speed the speed-sensitive clutch disconnects the motor and the gear reduction set from the output shaft so that rotation of the output shaft is not subject to resistance from the gear reduction set, and at motor speeds above the predetermined speed the output shaft is driven by the motor; and a direction control configured to switch the first direction associated with the ratchet mechanism between a clockwise and a counterclockwise direction, the direction control being coupled to the handle and spaced apart from the head along the handle axis.

2. The ratchet tool of claim 1, wherein the direction control is spaced at least one-third of a length of the handle away from the first end of the handle.

3. The ratchet tool of claim 2, wherein the direction control is spaced at least two-thirds of the length of the handle away from the first end of the handle.

4. The ratchet tool of claim 1, further comprising a mechanical linkage coupled between the direction control and the ratchet mechanism, the mechanical linkage extending generally parallel to the handle axis.

5. The ratchet tool of claim 1, further comprising a power control coupled to the motor and movable between an on position in which the motor drives rotation of the output shaft and an off position in which the motor does not drive rotation of the output shaft.

6. The ratchet tool of claim 5, wherein the direction control is coupled to the power control and is configured to select a direction of rotation provided by the motor when the power control is in the on position.

* * * * *